United States Patent [19]

Dworman et al.

[11] Patent Number: 4,878,867

[45] Date of Patent: Nov. 7, 1989

[54] COIN BANK

[75] Inventors: Ralph M. Dworman; Nancy S. Dworman, both of Worcester, Mass.

[73] Assignee: Ralphco Inc., Worcester, Mass.

[21] Appl. No.: 226,072

[22] Filed: Jul. 29, 1988

[51] Int. Cl.[4] ..... A45C 1/12; B65D 3/10; B65D 43/08; A63H 33/30

[52] U.S. Cl. ..... 446/8; 446/76; 229/5.5; 229/8.5; 220/352; 220/356; D9/307; D99/37

[58] Field of Search ..... 446/8, 9, 10, 11, 12, 446/13, 71, 76, 79, 180; D99/37, 34, 35, 36, 38, 39, 40; D7/5; D19/82; D9/307, 325, 329; 229/4.5, 5.5, 8.5; 220/352, 356

[56] References Cited

U.S. PATENT DOCUMENTS

| | | | |
|---|---|---|---|
| D. 127,448 | 5/1941 | Coller | D99/35 |
| D. 272,793 | 2/1984 | Appel et al. | D7/5 |
| D. 273,766 | 5/1984 | Lampe | D9/329 X |
| D. 277,335 | 1/1985 | Lieberman | D7/5 X |
| D. 280,361 | 9/1985 | Appel et al. | D9/307 X |
| 655,348 | 8/1900 | Moore | 220/356 |
| 1,274,010 | 7/1918 | Coventry | D99/35 X |
| 3,095,139 | 6/1963 | Randall et al. | D99/35 X |
| 3,847,277 | 11/1974 | Doner | 446/8 X |
| 4,051,992 | 10/1977 | Bergstein | 229/5.5 X |
| 4,163,517 | 8/1979 | Kappler et al. | 229/4.5 |

FOREIGN PATENT DOCUMENTS

| | | | |
|---|---|---|---|
| 208634 | 11/1966 | Switzerland | 446/8 |

*Primary Examiner*—Robert A. Hafer
*Assistant Examiner*—D. Neal Muir
*Attorney, Agent, or Firm*—Blodgett & Blodgett

[57] ABSTRACT

A coin bank having a cylindrical tubular intermediatre portion, a cap portion which has a hollow interior and a coin slot to the interior of the cap portion and a base portion which has a bottom wall. The cap portion has a cylindrical lower end which is inserted into the top of the tubular intermediate portion in a snug fit. The base portion has a cylindrical upper end which fits into the bottom end of the tubular intermediate portion in a snug fit for attaching the base portion to the intermediate portion.

3 Claims, 3 Drawing Sheets

FIG. 5
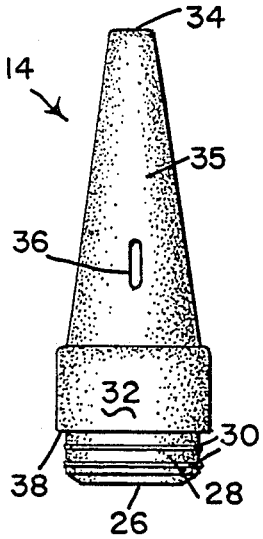
FIG. 6
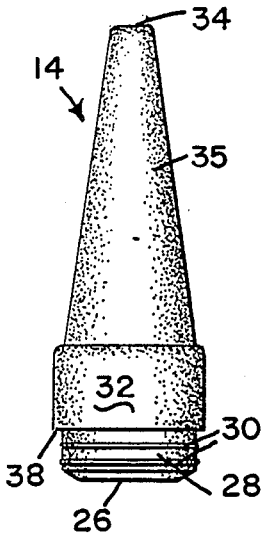
FIG. 10
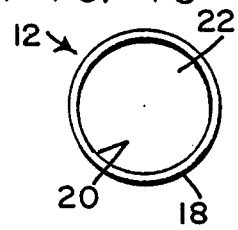
FIG. 9
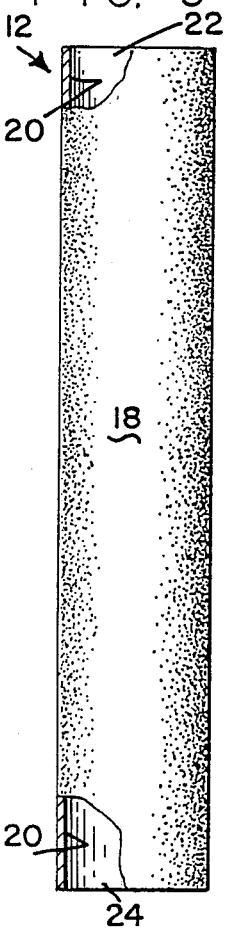
FIG. 11
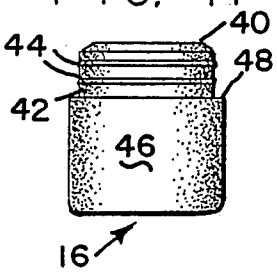
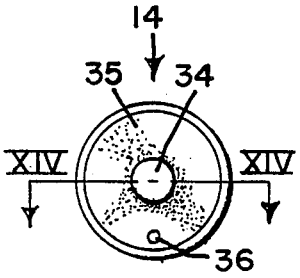
FIG. 7
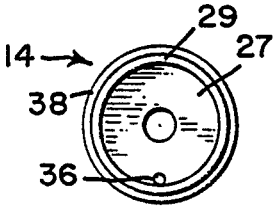
FIG. 8
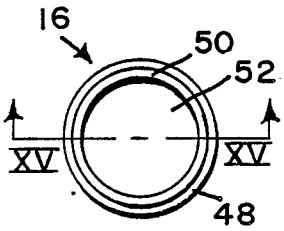
FIG. 12
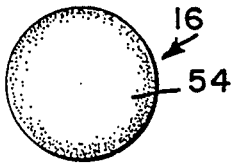
FIG. 13

COIN BANK

BACKGROUND OF THE INVENTION

The present invention is directed to a coin bank. Coin banks have been used for generations as a means of encouraging individuals, children in particular, to save. Coin banks are found in a variety of forms and shapes. The typical coin bank includes a hollow housing which has a slot at the upper portion of the housing for receiving coins. The coin banks are usually in the form of a familiar object such as a pig or other animal. It is easy to deposit coins in the slot but difficult to remove the coins from the bank through the slot. The coin bank is intended to encourage saving and to discourage removal of coins from the bank. Some earlier banks had to be broken when the bank was full in order to remove coins from the bank. Coins could also be painstakingly removed from the slot with the aid of a knife blade, or other similar object. If removal of coins from a coin bank is too easy, there is a strong temptation to remove coins from the bank before the bank is full. These and other difficulties experienced with the prior art coin banks have been obviated by the present invention.

It is, therefore, a principal object of the invention to provide a coin bank in which coins can be removed from the bank if it becomes necessary to do so but with some difficulty to discourage premature or frequent withdrawal of coins from the bank.

Another object of the invention is the provision of a coin bank which comprises several portions which are assembled quickly and easily and disassembled with greater difficulty to maintain its integrity as a single unit at various stages of being filled with coins.

A further object of the present invention is the provision of a coin bank which effectively receives and holds coins and which has a familiar and pleasing shape to encourage children to utilize the bank for saving.

It is another object of the present invention to provide a coin bank which is simple in construction, which is inexpensive to manufacture and easy to use.

With these and other objects in view, as will be apparent to those skilled in the art, the invention resides in the combination of parts set forth in the specification and covered by the claims appended hereto.

SUMMARY OF THE INVENTION

In general, the invention consists of a coin bank comprising a cylindrical tubular intermediate portion, a cap portion which fits into one end of the intermediate portion and a base portion which fits into the other end of the intermediate portion. The base portion has a upper opening and a bottom wall. The cap portion has a bottom opening and a coin slot above the bottom opening which enables coins to be deposited into the bank. More specifically, the cap portion has a cylindrical lower end which fits into the intermediate portion in a snug force fit and the base portion has a cylindrical upper end which fits into the other end of the intermediate portion in a snug force fit.

BRIEF DESCRIPTION OF THE DRAWINGS

The character of the invention, however, may be best understood by reference to one of its structural forms, as illustrated by the accompanying drawings, in which:

FIG. 5 is a front elevational view of the cap portion of the bank, FIG. 6 is a rear elevational view of the cap portion, FIG. 7 is a top plan view of the cap portion, FIG. 8 is a bottom plan view of the cap portion, FIG. 9 is a front elevational view of the cylindrical intermediate portion of the bank, FIG. 10 is a top plan view of the intermediate portion, the bottom plan view of the intermediate portion being identical to that of the top plan view, FIG. 11 is a front elevational view of the base portion of the bank, FIG. 12 is a top plan view of the base portion, FIG. 13 is a bottom plan view of the base portion.

DESCRIPTION OF THE PREFERRED EMBODIMENT

Figure 1:
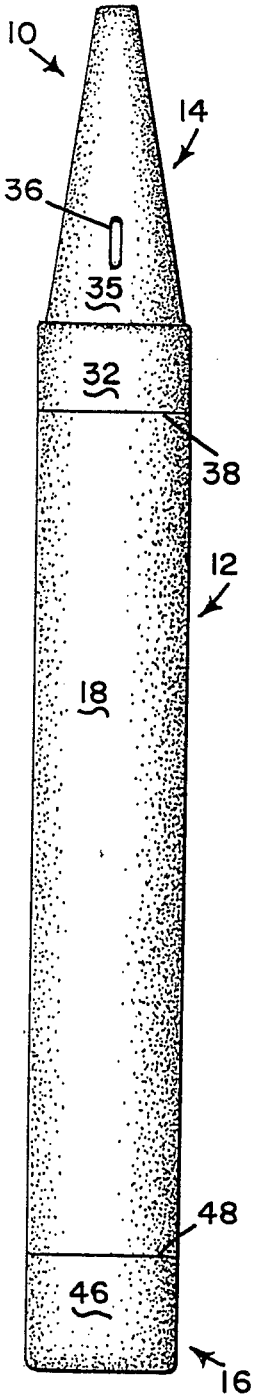
FIG. 1 is front elevational view of a coin bank embodying the principals of the present invention.

Referring first to FIGS. 1–4, the coin bank of the present invention is generally indicated by the reference numeral 10 and comprises a cylindrical tubular intermediate portion, generally indicated by the reference numeral 12, a cap portion, generally indicated by the reference numeral 14 and a base portion, generally indicated by the reference numeral 16.

Referring to FIGS. 1, 2, 9 & 10, the cylindrical tubular intermediate portion 12 has an outer cylindrical surface 18 and an inner cylindrical surface 20. The top of the tube 12 has a circular top opening 22. The bottom of the tube 12 has a circular bottom opening 24.

Figure 2:
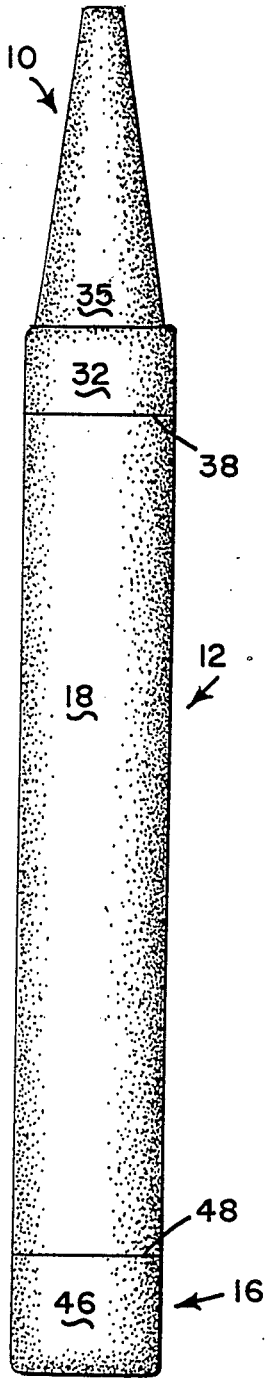
FIG. 2 is a rear elevational view of the bank.
Figure 3:
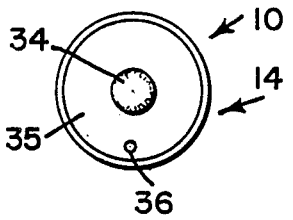
FIG. 3 is a top plan view of the bank.
Figure 4:
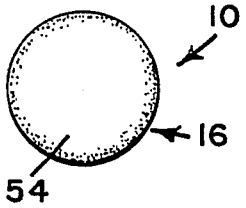
FIG. 4 is a bottom plan view of the bank.
Figure 14:
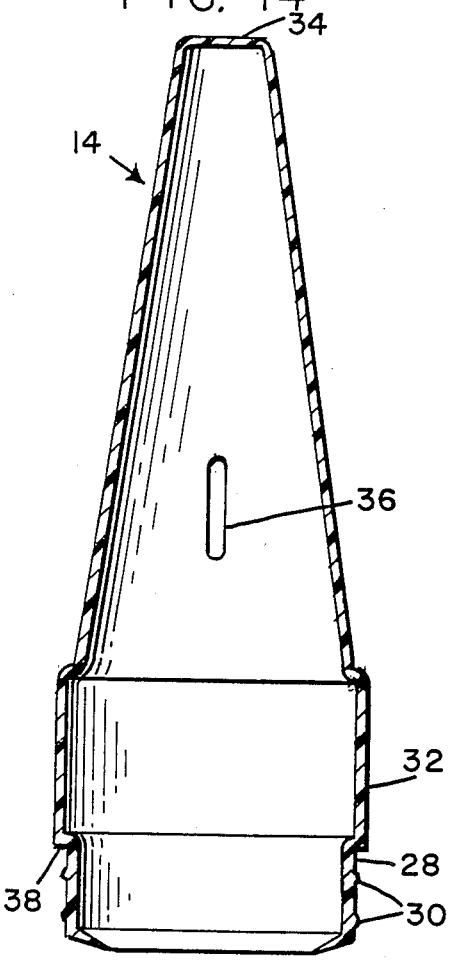
FIG. 14 is a vertical cross-sectional view of the cap portion of the bank taken along the line XIV—XIV of FIG. 7 and looking into the direction of the arrows.
Figure 15:
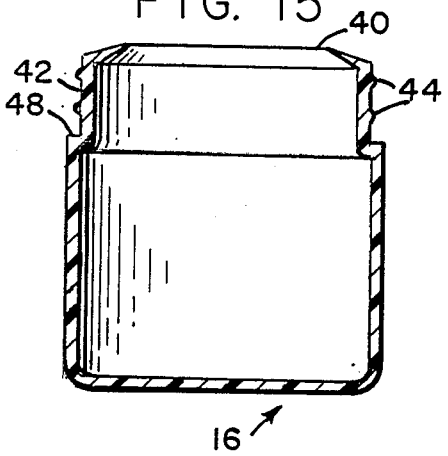
FIG. 15 is a vertical cross-sectional view of the base portion of the bank taken along the line XV—XV of FIG. 12 and looking in the direction of the arrows.

Referring to FIGS. 1, 2, and 5–8, the cap portion 14 includes a cylindrical lower end section 26 which has an outer cylindrical vertical surface 28 and a pair of annular beads or ridges 30 which protrude from the surface 28. The beads 30 extend horizontally about the surface above the surface 28. The cap 14 has a cylindrical intermediate outer surface 32 which has the same diameter as the surface 18. The diameter of the surface 28 is substantially less than the diameter of the surface 32 so that an annular shoulder 38 is formed between the surfaces 28 and 32. The surface 28 fits snugly within the opening 22 of the tubular intermediate portion 12. When the cylindrical lower end 26 is fully inserted into the intermediate portion 12 so that the shoulder 38 rests against the top edge of the tubular intermediate portion 12, the surface 32 is continuous with the surface 18 as shown in FIGS. 1 and 2. The beads 30 are relatively small but add sufficient frictional resistance to movement of the lower end 26 within the tubular intermediate portion 12 so that the cap portion 14 remains attached to tubular intermediate portion 12 during normal handling of the coin bank 10. However, the cap 14 can be removed from the intermediate portion 12 when it becomes necessary to do so. The cap 14 also includes a top surface 34 and a conical outer surface 35 which tapers inwardly from the surface 32 to the top surface 34. A coin slot 36 is located at the surface 35 and extends through the wall of the cap portion 14. The bottom of the cap 14 has an inwardly directed annular flange 29 which defines a circular bottom opening 27.

Referring to FIGS. 1, 2, 11–13 and 15, the base 16 includes a cylindrical upper end 40 which has a vertical cylindrical outer surface 42. A pair of annular beads or ridges 44 extend from the surface 42 and lie in separate horizontal planes. The lower part of the base portion 16 includes a bottom wall 54 and a vertical cylindrical outer surface 46 which has the same diameter of the outer surface 18 of the tubular intermediate portion 12. The diameter of the cylindrical surface 42 is substantially less than the surface 16 so that an annular shoulder 48 is formed between the surfaces 42 and 46. The top of the cap has an inwardly directed annular flange 15 which defines a circular top opening 52. The cylindrical upper end 40 of the cap fits snugly within the opening 24 of the tubular intermediate portion 12. When the cylindrical upper end 40 is inserted into the bottom opening 24 of the intermediate portion 12 so that the shoulder 48 abuts the bottom edge of the tubular portion, the cylindrical surface 46 is continuous with the outer surface 18 of the intermediate portion 12 as shown in FIGS. 1 and 2. The ridges 44 are relatively slight but create sufficient frictional resistance to sliding so that when the base portion 16 is attached to the intermediate portion 12 by inserting the cylindrical upper end 40 of the base portion into the bottom opening 24 of the intermediate portion 12, the portions 12 and 16 will remain attached through normal handling of the coin bank. However, the base portion 16 can be removed from the intermediate portion 12 when it becomes necessary to do so. The portions 12, 14 and 16 can be made of any relatively rigid material. However, it is preferred that he cap portion 14 and the base portion 16 be formed of a plastic material while the intermediate portion 12 is formed of rigid cardboard material. The portions 12, 14 and 16 are formed separately and assembled to form the coin bank 12 by inserting the cylindrical lower end 26 of the cap portion into the opening 22 until the shoulder 38 meets the top edge of the intermediate portion. The cap portion 16 is attached to the intermediate portion by inserting the cylindrical upper end 40 into the opening 24 of the intermediate portion until the shoulder 48 meets the bottom edge of the intermediate portion. Once assembled, the portions 12, 14 and 16 remain intact through normal use of the coin bank due to the snug fit of the cap and base portions 14 and 16 respectively, to the intermediate portion 12. The snug fit is created in part by the ridges or beads 30 and 44. The bank 10 can thereafter be used by standing the bank 10 in the upright position shown in FIGS. 1 and 2 with the bottom wall 54 resting on a flat supporting surface. Coins are inserted into the bank through the slot 36. The coins fall through the bottom opening 27 of the cap portion 14 through the intermediate portion 12 through the top opening 52 of the base portion 16 to the bottom wall 54. As additional coins are added to the bank, the bank becomes more stable due to the increasing weight of the coins within the bank. When the coin bank 10 is filled with coins or the deposited coins reach a predetermined level in the bank, the coins can be removed from the bank by removing the cap portion 14 or the base portion 16 from the intermediate portion 12 to expose one end opening of the intermediate portion so that coins within the bank can be poured out of the bank and collected.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A coin bank comprising:

(a) a cylindrical tubular intermediate portion which has a vertical central longitudinal axis, a circular inner surface, a circular outer surface, a top end with a top opening and a bottom end with a bottom opening, (b) a cap portion which has a hollow interior, a top surface a cylindrical lower end which fits snugly within the top end of said intermediate portion so that said cap portion is removably attached to the top end of said intermediate portion, a bottom opening at said lower end, a circular intermediate outer surface having an outer diameter which is the same as the outer diameter of the circular outer surface of said intermediate portion so that when said cylindrical lower end is inserted within said intermediate portion, the circular intermediate outer surface of said cap and the circular outer surface of said intermediate portion define a single continuous outer surface, a conical outer surface which tapers inwardly from said intermediate outer surface to said top surface, and a coin slot in said conical surface to the interior of said cap portion, (c) a base portion which has a bottom wall and a cylindrical upper end which is removably attached to the bottom end of said intermediate portion, said cylindrical upper end having a top opening so that a coin which is inserted into said slot falls through the bottom opening of said cap portion, through the intermediate portion and through the top opening of said base portion to said portion to said bottom wall.

2. A coin bank as recited in claim 1 wherein the cylindrical lower end of said cap has an outer vertical circular surface which includes at least one circular horizontal bead.

3. A coin bank as recited in claim 1, wherein the cylindrical upper end of said base portion fits snugly within the bottom end of said intermediate portion, said base having a circular lower outer surface having an outer diameter which is the same as the outer diameter of the circular outer surface of said intermediate portion so that when said cylindrical upper end if inserted within said intermediate portion, said lower outer surface is continuous with the circular outer surface of said intermediate portion.

* * * * *